United States Patent [19]

Falgout, Sr. et al.

[11] Patent Number: 4,715,253

[45] Date of Patent: Dec. 29, 1987

[54] LINE WRAP POWER TONGS

[75] Inventors: Thomas E. Falgout, Sr.; William N. Schoeffler, both of Lafayette, La.

[73] Assignee: Team Engineering and Manufacturing, Inc., Youngsville, La.

[21] Appl. No.: 838,459

[22] Filed: Mar. 11, 1986

[51] Int. Cl.[4] ..... B25B 17/00

[52] U.S. Cl. ..... 81/57.14; 81/57.17; 81/57.3; 81/57.33

[58] Field of Search ..... 81/57.17, 57, 57.11, 81/57.14, 57.15, 57.16, 57.3, 57.33, 57.34, 57.43

[56] References Cited

U.S. PATENT DOCUMENTS 3,373,638 3/1968 Donnam ..... 81/57.17

*Primary Examiner*—Frederick R. Schmidt

*Assistant Examiner*—Maurina Rachuba

*Attorney, Agent, or Firm*—John D. Jeter

[57] ABSTRACT

A power tong has two powered rings mounted on the tong frame for independent rotation, one ring, a reel carrier, carries a plurality of spring rewind line storage reels. Independent lines extend from each reel and each line is anchored to the second powered ring. An open gap, or throat, extends to the tong center to receive pipe when the lines are all recovered into the reels. The reel carrier ring is rotated to wrap the lines in a spiral pattern around pipe. The second ring is driven to pull the lines and the reel carrier ring is braked to apply tailing tension to the lines but does then turn in sympathy with the second ring to turn pipe. To recover the lines, the second ring is stopped and the reel carrier ring is driven in the direction to allow lines to return to the reels as they unwrap from the pipe.

26 Claims, 14 Drawing Figures

LINE WRAP POWER TONGS

Apparatus of this invention is definable as a powered pipe tong to be used by drilling and workover rigs to manipulate threaded connections of pipe strings suspended in earth boreholes or wells.

RELATED ART

Conventional power tongs used to accomplish the same purpose as apparatus of this invention by different means are typified by the following U.S. Pat. Nos. 4,084,453; 4,273,010; 4,404,876; 4,089,240; 4,290,304; 4,445,403; 4,266,450; 4,350,062; 4,487,092.

There are no known prior patents related to balanced spiral line wrap power tongs. The word "tong" suggests the use of pipe gripping dies, which are not present in the apparatus of this invention.

BACKGROUND OF THE INVENTION

The use of a spiral wrap of a line of rope or chain to spin a pipe in the first stages of pipe thread make-up in pipe string assembly is old art. In well drilling practice, the line is wrapped several turns around the pipe, and the tailed end is held with some tension as the other end is pulled by a capstan, usually a powered capstan. The greater the number of turns around the pipe to be rotated, the less tension is required on the tailed end.

In well drilling, the powered line has not been used to apply final torque to the pipe, because the side loads are too great and the tensioned line becomes dangerous to personnel. Tongs are used to apply final torque.

Pipe spinners of the chain and wheel type, and combinations of the two, have come into common use to spin pipe at low torque. Tongs, some powered, have been used to apply high torque as required.

Conventional power tongs used to apply high torque loads to pipe have pipe gripping dies. The dies cause surface damage to pipe. Efforts to minimize the damage has continued for years and it has been reduced to some extent. All tubular goods used in well drilling and well completion have become more expensive. Pipe used in wells with hydrogen sulfide is very expensive and has sensitive surfaces. Damage to the surface defeats the chemical attack resistant surface treatment. In recent years, there has been an increasing sense of urgency associated with pipe surface protection.

OBJECTS

It is therefore an object of this invention to provide apparatus to mechanically wrap line around pipe to rotate the pipe, and to unwrap and recover the line.

It is another object of this invention to provide apparatus to mechanically wrap a plurality of lines around pipe fed from bias retracting reels, and to recover the lines into the reels when the pipe turning operation is completed.

It is still another object of this invention to provide apparatus to mechanically wrap lines around pipe to be rotated apparatus to mechanically wrap lines around pipe to be rotated by feeding the line from reels that collectively rotate as required around the pipe centerline, as line is paid out from or recovered into the reels.

It is yet a further object of this invention to provide apparatus to mechanically wrap lines around pipe to be rotated, the pulled ends of the lines to be powered by a ring capable of being rotated around the pipe centerline to apply torque to the pipe, with a cooperating but independently rotatable ring also capable of rotation around the pipe centerline to carry reels to pay out and to recover the lines.

It is still another object of this invention to provide a line wrapping power tong with a gapped side to allow pipe to move laterally to and from the operational center of the apparatus.

It is yet another object of this invention to provide apparatus to spiral wrap a plurality of lines around pipe to be rotated, the lines further controlled by level wind axial advance controls related to the amount of line wrapped on pipe to assure a reasonably uniform, closely spaced, helix pattern of lines applied to pipe.

It is still a further object of this invention to provide directional choice to level wind controls, so that line will advance axially along the pipe periphery whether the pipe is to be rotated to make up or break out threads.

These and other objects, advantages, and features of this invention will be apparent to those skilled in the art from a consideration of this specification, including the attached drawings and appended claims.

SUMMARY OF THE INVENTION

Apparatus of this invention utilizes the general concept of conventional power tongs adapted to control, manipulate, and drive a plurality of spiral wrap lines to rotate pipe both for spinning at low torque and to apply the required high torque loads.

A balanced array of lines is situated around the pipe periphery to extend some distance parallel to the pipe axis with each end anchored to structure capable of independent rotation. Rotation of one end of the array of lines, relative to the other end and about the pipe axis, causes the lines to wrap the pipe in a spiral of lines. The lines are fed from biased rewind reels as the wrap takes place. The undriven (or tailed) ends of the lines are restrained, both in tension and in rotation, about the pipe centerline by a reel carrier ring. The resistance is limited, and the tailed ends of the lines eventually rotate with the reel carrier, reluctantly, as the pipe is rotated by the powered ring pull on the lines. When rotation is complete, the reel carrier is powered to overrun the driving ring to unwrap the spiral and recover, into the reels, the individual lines, until the lines are again parallel the pipe axis. A throat may be used in the side of the body and the rotating assemblies to allow the pipe to be moved laterally in and out of the tong open, generally central, area. An alternate embodiment includes an arrangement to advance the free end of the reel supplied lines axially along the pipe, as spiral winding evolves, to prevent the lines sliding on the pipe surface as the helix angle of the lines changes.

DETAILED DESCRIPTION OF DRAWINGS

Figure 1:
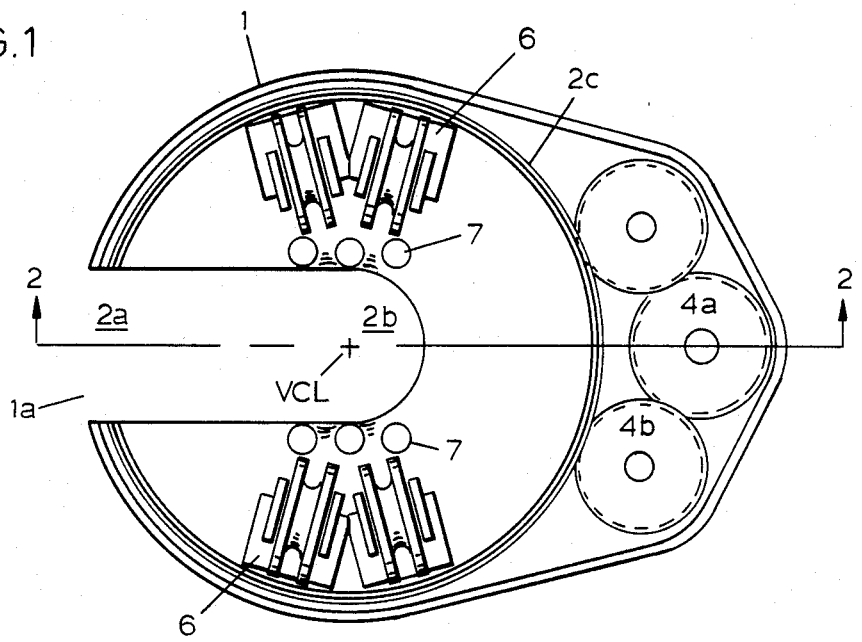
FIG. 1 is a plan view, partially cutaway, of the body, principal rotating machinery and power transmission layout common to all embodiments of the invention.
Figure 2:
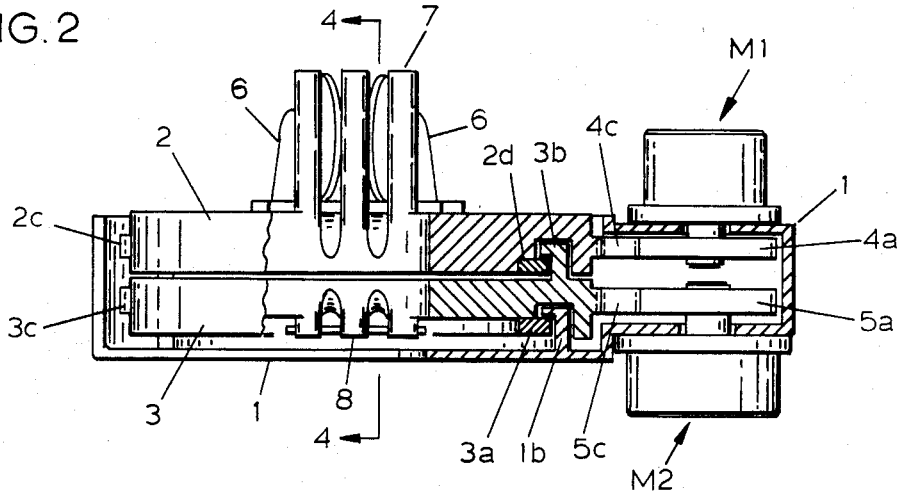
FIG. 2 is a sectional view, taken along lines 2—2 of FIG. 1, and shows input drive motors.
Figure 3:
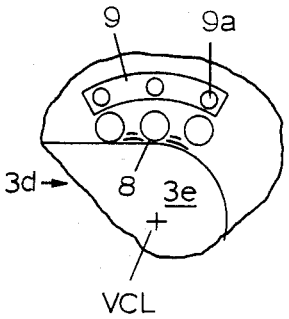
FIG. 3 is a projection of a selected area of FIG. 2.

In FIGS. 1, 2, and 3 the general structure for all subsequent figures is described. In FIG. 1, body 1 provides support and general enclosure for the primary machinery. Partial ring 2 has a throat 2*a* and an opening 2*b*. The vertical axis VCL is perpendicular to the plane of the drawing. Axis VCL is the center of rotation of pipe to be rotated by the tong and the center of rotation of partial ring 2 and partial ring 3, which is invisible below partial ring 2, as will be described later. Body 1 is often referred to as a frame on conventional tongs.

Gear 4*a* is the primary input gear for driving ring 2. Gears 4*b* and 4*c* are idler gears which engage gear 4*a* and ring gear 2*c*. Gear 2*c* is affixed to partial ring 2. The spread of gears 4*b* and 4*c* provide continuous power transmission from gear 4*a* to gear 2*c* as the throat 2*c* is negotiated during each revolution of gear 2*c*. This is conventional power tong gearing. Gears 5*a*, 5*b*, and 5*c* invisible below gears 4*a*, 4*b*, and 4*c* have a similar layout, as will be described later. Partial rings 2 and 3 are each capable of independent continuous rotation in either direction.

Four independent line reels 6 are mounted on partial ring 2, and this ring will be referred to as a reel carrier ring.

Six posts 7 stand vertically on ring 2 near the throat, and will be referred to as line tailing posts for reasons to be explained later. The principal purpose of posts is to extend structure to make slots available for lines.

In FIG. 2, partially cutaway, taken along line 2—2 of FIG. 1, the two partial rings 2 and 3 are shown. Ring 3 is supported for rotation on body 1 by bearing ring 1*b*, and secured by retaining ring 3*a*, which is rigidly attached to ring 3. Ring 2 is mounted for relatively independent rotation on ring 3 by support ring 3*b*. Ring 2 is secured on support ring 3*b* by confining ring 2*d*, which in turn is rigidly attached to ring 2. Fasteners that secure the rings 1*b*, 3*a*, 3*b*, and 2*d* and lend maintenance utility to the assembly are omitted for clarity of points of novelty, since such fasteners are well established in the art.

Motor M2 is mounted on the body 1 and drives gear 5*a*, which in turn drives idler gears 5*b* and 5*c*. These gears have the same general layout as gears 4*b* and 4*c* for reasons already described, to negotiate the throat 3*d* in ring 3, which corresponds to throat 2*a* in ring 2 as seen in FIG. 1.

Motor M1 drives ring 2 through the gears 4*a*, 4*b*, and 4*c* as previously described. Motor M1 is mounted on body 1.

Line driving posts 8 are part of ring 3 and may be intrinsic or attached by convenient structural means. In the positions shown, posts 7 and posts 8 are in general registry. These posts are to manipulate flexible elements to wrap and drive pipe, but this function is best described after the structure is defined.

FIG. 3 is a projection of a selected area of FIG. 2. Line driving posts 8 are shown near the throat. There are six such posts, three shown, the other three are similarly situated on the opposite side (not shown) of the opening 3*e*. Line clamp 9 and retaining bolts 9*a* will retain the driven end on the two lines (flexible elements). A similar arrangement (not shown) is on the opposite side of opening 3*e*, and is similarly disposed relative to axis VCL.

Figure 4:
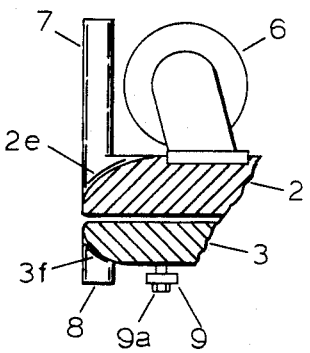
FIG. 4 is a cutaway taken along line 4—4 of FIG. 2, showing a profile around which line will be installed.

FIG. 4 is a cutaway taken along line 4—4 of FIG. 2. The profile of line slide grooves 2*e* and 3*f* is typical of the profiles each side of the central posts of post groups 7 and 8. The overall assembly is designed, in this case, for four independent lines, but any multiple of two can be used if space is available for reels. The number of slide paths and slots can be changed to accommodate the preferred plurality of lines.

Line clamps and bolts 9 and 9*a* secure the driven end of the lines to ring 3. Reels 6, only one shown, control the tailed end of the line in a manner to be described later. As shown, posts 7 and 8 appear intrinsic to their related partial rings. The post sets, with slide grooves in place, are expendables and bolt to recesses in the associated partial rings. This attachment feature is not a point of novelty, and is within the machine construction art and not shown in detail, to preserve functional clarity of drawings.

All line tailing reels, one for each line, are of the spring biased line retracting type. The spring return reel is a common purchase item usable to support heavy power tools on assembly lines. They can be purchased for various sizes of lines, flat web straps, hoses, and the like with a variety of line length capacity and various spring strengths for applying line recovery tension. Some embodiment choices require modification for the purpose disclosed. The modifications are detailed where used, but the common retract mechanism is considered well established in the art:

Addressing now the flexible elements to use on the structures described, it should be noted that the flexible element referred to herein as a line may have a variety of forms. For rotating smooth, clean pipe, nylon rope has been found quite effective. Oily pipe responds well to steel cable of the very flexible type. The very flexible steel cable has small individual wires, however, and existing burrs on used pipe seem to damage cable too often. We are still searching for a general purpose line and may yet construct the appropriate special purpose line. The line type is subject to change from time to time. The descriptive material herein is oriented to the artificial fiber line but should not be considered in any way restrictive.

Figure 5:
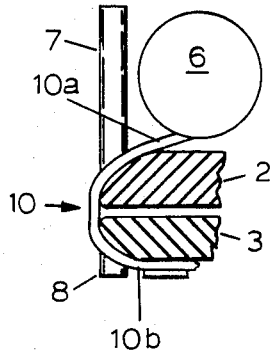
FIG. 5 is similar to FIG. 4, showing a flexible element or line, installed in one of a plurality of positions.

FIG. 5 is identical to FIG. 4, with line 10 shown in the recovered position. In initial installation of lines, the individual line is installed on the related spring retract reel. The driven end of the line is pulled from the reel, laid in the appropriate slide way, and clamped by clamp 9, while rings 2 and 3 are positioned with the ring throats 2*a* and 3*d* in registry. In this position, with throat 1*a* in the frame, throat 2*a* in ring 2, and throat 3*d* in ring 3 in registry, pipe may be moved laterally into the openings. The arrangement of FIG. 5 is on one side of the throat. A similar arrangement (not shown) is on the opposite side, as shown in FIG. 6.

Figure 6:
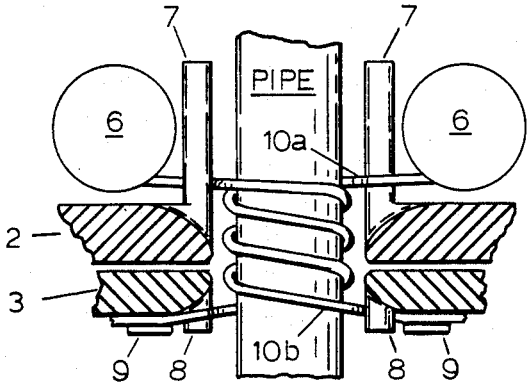
FIG. 6 is a cutaway showing a pair of opposed features, each similar to FIG. 5 after the device has been used to wrap line around pipe.

In FIG. 6, ring 2 has been rotated two turns relative to ring 3. Only two lines are shown for simplicity. If viewed from above, ring 2 has made two turns to spiral wrap lines, clockwise in this case, around the pipe. More turns are commonly made before ring 3 is driven counterclockwise, in this case, to rotate pipe. The number of turns of line depends upon circumstance, but when enough turns are on the pipe, ring 3 is driven counterclockwise to drive pipe. Ring 2 is allowed to turn in sympathy with ring 3, but a restraining force is kept on the tailed end of the lines by braking ring 2. Reel tension and the braking action on ring 2 prevents line slippage. Should slippage occur, more turns of line are applied to the pipe. To turn pipe in the opposite direction, the directions described above are reversed.

The line applies torque to the pipe in accordance to the equation $T_t(e^{fa}-1)r$ where $T_t$ is the line tailed end tension, f is the coefficient of friction between line and pipe, a is the amount of line in contact with the pipe in radians, and r is the pipe radius. The equation defines the point of slippage for one line.

The ratio of driven end tension $T_d$ to tailed end tension $T_t$ is expressed by the equation $T_d/T_t=e^{fa}$. The line driven end is attached to ring 3 by clamps 9.

With five wraps of line with a friction coefficient of 0.1, the $T_d/T_t$ ratio becomes 23.

With five turns of line with a friction coefficient of 0.1 and 100 pounds tension on the tailed ends of each of four lines, the torque applied to a six inch pipe is 2,200 foot pounds. Six turns of line, under the same circumstance, delivers 4,238 foot pounds.

With the friction increased to 0.2, three turns of line on the same pipe delivers 4,237 foot pounds of torque.

Figure 7:
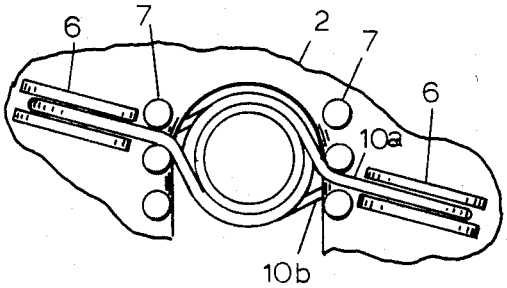
FIG. 7 is a view from the top of FIG. 6.

FIG. 7 is a top view of FIG. 6 showing the lines 10 wrapped around pipe in preparation for rotating pipe. The mounting of reels 6 on ring 2 has already been described, and the reel mounts are not shown. Only two reels are shown in position so that both ends of each line can be seen. Line tailed end 10*a* goes to the reel, and end 10*b* goes to clamp 9, not visible in this figure but as shown in FIGS. 5 and 6.

Figure 8:
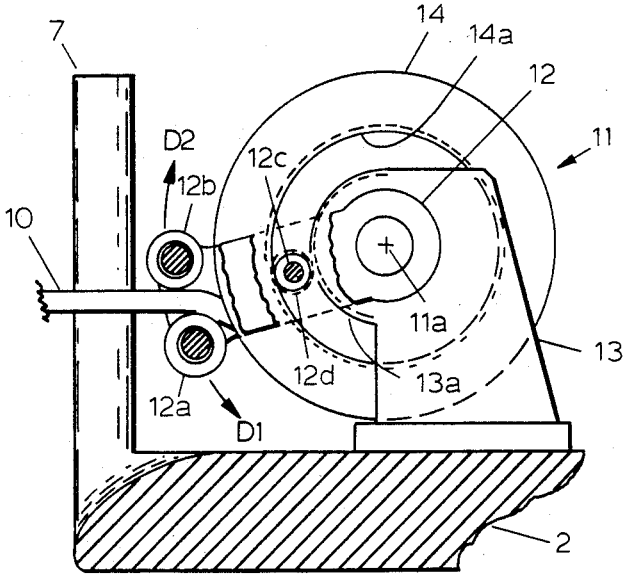
FIG. 8 is a side view, partly cutaway, of a preferred embodiment of one of a plurality of line reels.

FIG. 8 shows a modified reel assembly 11, a preferred embodiment, to replace reels 6. The apparatus is otherwise unchanged from that previously described herein. This embodiment of the reel provides a reasonably uniform spiral of line around pipe.

When line 10 is pulled from reel 14 of the reel assembly 11, control arm 12 is caused to pivot around reel axis 11*a* and move in the direction of arrow D2. When line 10 is allowed to be recovered into reel 14, control arm 12 moves in the direction of arrow D1. Control arm 12 is caused to pivot by gear axle 12*c* and gear 12*d*. Gear 12*d* runs between annular internal gear 14*a* of reel 14 and sector gear 13*a*, which is cut on mount 13. One control arm 12 is situated on each side of the reel assembly. The near side arm is cut away to show the gear. In the embodiment used to rotate small pipe, a single gear 12*d* is situated on each side of reel 14 and is mounted for rotation by way of axle 12*c*, one on each control arm 12. For rotating small pipe, there is less line pulled out of reel 14 for each turn of line on the pipe compared with large pipe, and this simple gearing moves control arm 12 an appropriate amount per turn of reel 14.

When larger pipe is to be rotated, reel 14 turns a greater amount per revolution of ring 2 relative to ring 3, and control arm 12 must be geared to move a smaller amount per turn of reel 14.

Figure 9:
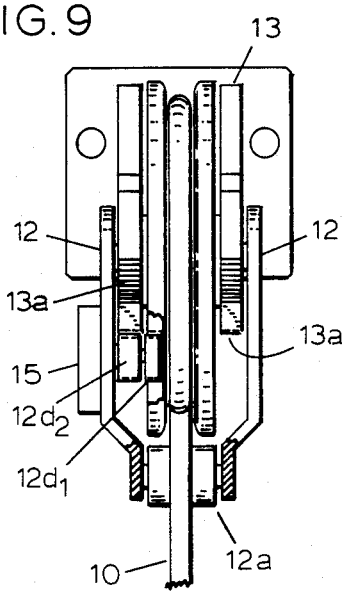
FIG. 9 is a top view of the reel assembly of FIG. 8, showing a modification for use in selected cases.

FIG. 9 is a top view of the reel assembly 11 of FIG. 8. Reduction gearbox 15 is added to control arm 12. There is only one reduction gearbox, because the reel assemblies as mounted on reel carrier ring 2 are too close together for gearboxes to clear on both sides. The single gear 12*d* is replaced by gears 12*d*1 and 12*d*2; independent but on coaxial axes are shafts extending from gearbox 15. The gearbox is fastened to the appropriate control arm 12. Both control arms 12 are themselves identical. The gearbox reduces the ratio of movement of the control arms relative to reels 14. The reduction gearing is not detailed because it is changed for various ranges of diameters of pipe to be rotated by the apparatus. Such gearing within the gearboxes is common to machine construction art.

All control arm gearing is driven by gear 14*a*, and directly, or by reduction, drives the control arm through an arc about axis 11*a*, by operating on stationary gear 13*a*.

Rollers 12*a* and 12*b* only control the vertical position of line 10, because peripheral forces on the line are opposed by posts 7. When line 10 is in the starting position, as shown in FIG. 5, control arm 12 is in the lowest position indicated by arrow D1. Control arm 12 can pivot upward in direction D2 about 70 degrees, as line 10 reels out to wrap line around pipe. This results in a fairly uniform spiral wrap.

If flat web belts are used for lines 10, the rollers 12*a* and 12*b* will force the belts to twist to a horizontal condition for recovery into reel 14.

FIGS. 10 through 14 apply to an alternate embodiment of the apparatus including alternate forms for the reel carrier ring and the powered partial ring, formerly rings 2 and 3 respectively. The frame and ring drive gearing remains unchanged and conform to those features described for FIGS. 1 and 2. Frame, motors, and ring drive gearing are not again detailed for FIGS. 10 and 11.

Figure 10:
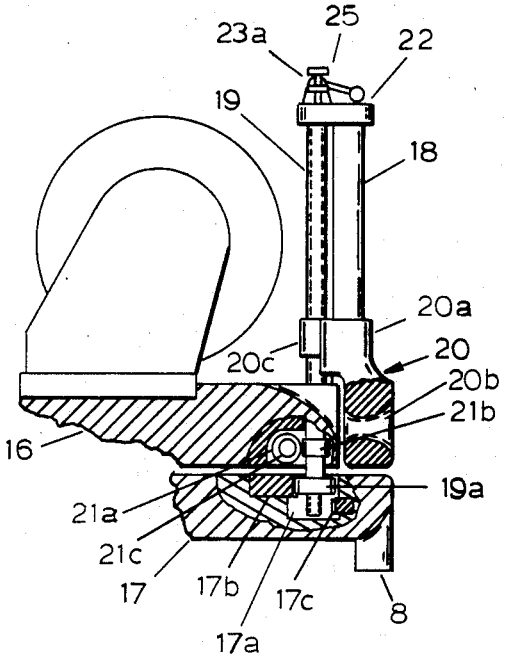
FIG. 10 is a side view, partially cutaway, of one of two opposed similar structures, showing an alternate embodiment of the invention.

In FIG. 10, reels 6 are positioned on and attached to ring 16 as previously described herein. Ring 16, the reel carrier, has notch 16*a* to accept line feed horn block 20. Only one arrangement is shown, an identical such arrangement is on the opposite side of axis VCL, and only one will be described. Guide columns 18 are secured to ring 16, one on each peripheral side of notch 16*a*. Block 20 has bushings 20*a* slidably situated around the columns, and can move vertically up and down the columns. The blocks 20 also have threaded bushings 20*c* attached to the blocks and engage the threads on lead screw 19. Lead screw 19 is axially affixed to ring 16 for relative rotation. The lead screw is rotated by relative rotation between ring 16 and ring 17. Ring gear 17*b* is affixed to ring 17. Lead screw pinion 19*a* is slidably splined and rotationally secured one on each lead screw in an annular clearance 17*a* in ring 17.

As previously described herein, rings 16 and 17 have throats to admit pipe to be rotated and ring gear 17*b* has a discontinuity at the throat. To synchronize the two lead screws 19, and to negotiate the discontinuity in ring gear 17*b*, the lead screws are connected by a gear train including gear 21*b* and mating right angle gear 21*a*. These are spiral gears. A gear 21*b* is affixed to each lead screw, and gear 21*a* is affixed to shaft 21*c*. Shaft 21*c* is horizontal, mounted for rotation on ring 16, and extends to a similar gear arrangement for the mating lead screw on the opposite side of notch 16*a*. Thus the two lead screws are synchronized, and both continue to rotate in unison when one gear 19a is in the discontinuity of ring gear 17b. (Note FIG. 13 for the situation of shaft 21c.)

Pipe to be rotated can be rotated in either direction to make up or break out threaded connections. The lines must be advanced along the pipe periphery in either direction of relative rotation of rings 16 and 17. This requires the ability to reverse the gearing driving the lead screws.

Each pinion 19a is mounted on the operatively related lead screw by mating splines, and the gear is pinned to a reverser rod which extends through the hollow lead screws. This arrangement will be described in more detail later. In FIG. 10, the internal ring gear 17c, attached to ring 17, should be noted. When pinion 19a is moved downward, it is briefly engaging both ring gear 17b and 17c. All pinions 19a are shifted at once, and the brief double engagement preserves synchronization throughout the useful life of the assembly. Further downward movement of gears 19a disengages them from gear 17b and fully engages them with gear 17c. Lead screw reversal only occurs when the throat openings of rings 16, 17, and frame 1 are in registry, and selection of make up or break out of pipe threads is made.

The gearing ratio is slightly changed when the pinions are shifted from external ring gear 17b to internal ring gear 17c, but the synchronization is assured, and the spiral wrap of lines around pipe to be rotated tolerates the resulting slight variation in helix angle.

Figure 11:
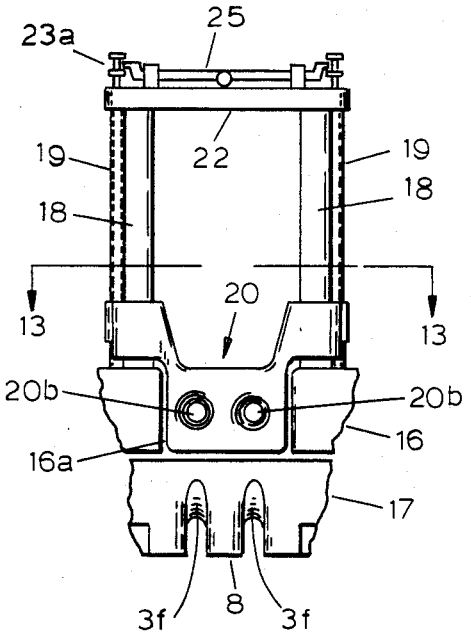
FIG. 11 is a projection of FIG. 10. No flexible elements yet installed.

FIG. 11 is a projection of FIG. 10 and is viewed from the throat around axis VCL. If rings 16 and 17 are rotated 180°, a similar view of the opposed structure would be identical. Bracing structure 22 is attached to columns 18 and contains bearing bushings for the upper end of the feed screws 19. When lines are installed, one line will extend through horn openings 20b. There are two such openings on the side viewed and four openings for the apparatus. Line driving posts 8 and line slide grooves 3f are as previously described herein.

Figure 12:
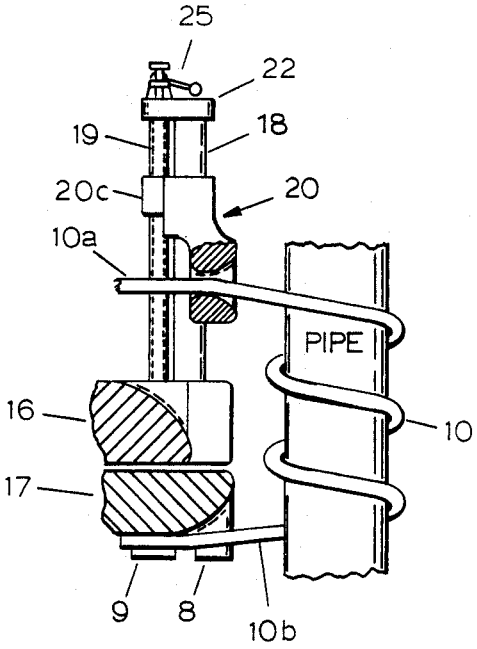
FIG. 12 is a view similar to FIG. 10, some parts omitted, showing one of a plurality of lines typically wrapped around pipe.

FIG. 12 is the same view as FIG. 10 with less cutaway and less detail shown. The single line 10 is representative of the four used on the full assembly. The spiral of the single line shown leaves room for the other three lines. All four lines result in nearly covering the pipe periphery. Ring 16 has completed three revolutions around the pipe relative to ring 17. Block 20 can normally travel upward on columns 18, forced upward by lead screw 19 in engagement with threaded bushing 20c, to allow five rotations of ring 16 relative to ring 17. In use, both rings would now be rotated counterclockwise viewed from above. As previously described herein, ring 16 will be braked to provide line tailing tension as ring 17, by way of clamp 9 and driving post 8, applies tension to the driven end of the line to rotate pipe.

Figure 13:
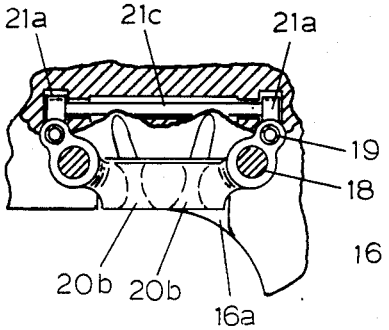
FIG. 13 is a top view of FIG. 11, cut at line 13—13.

FIG. 13 is a view taken along line 13—13 of FIG. 11. This view shows the relationship of the line feed horns 20b and notch 16a. Ring 16 is cutaway to show shaft 21c and gears 21a. Shaft 21c is mounted on ring 16 for rotation around its horizontal axis. No lines or reels are shown. Note that lead screws 19 are tubular.

Figure 14:
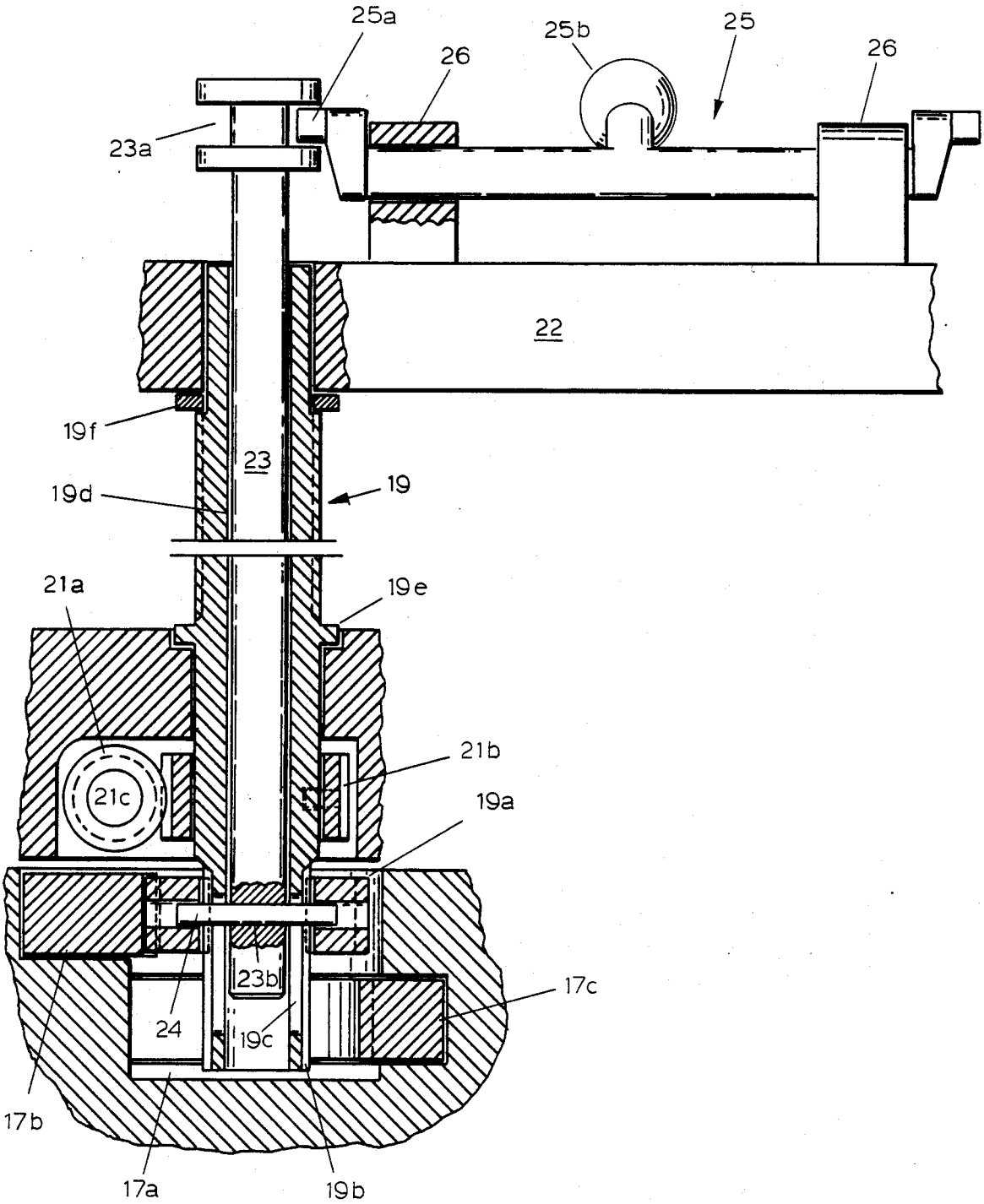
FIG. 14 is a side view, partly cutaway, and considerably enlarged, of a gear reverser contrivance, viewed in the general aspect of FIG. 10.

FIG. 14 is intended to show the elements involved in changing the direction of rotation of the lead screws relative to the relative rotational direction of rings 16 and 17. Bracing structure 22 is rotated out of normal position around the longitudinal axis of the lead screw to show reverser linkage. Ring 17 and gears 17b and 17c, as well as pinion 19a have been described. Lead screw splines 19b engage a mating spline in pinion 19a, and the pinion can slide axially relative to the lead screw. Shift rod 23 extends along the bore 19d of the lead screw. Rod 23 has a transverse hole 23b to snugly fit cross pin 24, which is secured in a transverse hole in pinion 19a, and is free to move axially in slots 19c through the wall of the lead screw. At the top end, rod 23 extends beyond the end of the lead screw and has spool 23a to allow rod 23 to rotate but engage pin 25a to follow the vertical motion of the pin. Crank throw pin 25a is part of crank 25. Crank 25 is mounted for rotation about a horizontal axis in pollow blocks 26 which, in turn, are secured to structure 22. Handle 25b can be manually moved to rotate crank 25 about 180° to move crank throw pin 25a downward. This moves gear 19a, from the position shown, downward to disengage the pinion from gear 17b and to engage gear 17c.

The lead screw 19 is positioned vertically by shoulder 19a abutting an opposed surface on ring 16 and shoulder 19f abutting a lower surface of structure 22. Each crank 25 controls the rotation of a pair of lead screws operatively associated with each line feed horn block 20.

The weight of handle 25b retains the selected position.

It is unnecessary to use a throat in the side of power tongs to rotate pipe. The throat only allows the tongs to be removed from the pipe and to be moved away at any time. Power tongs are often used without the side throat and are left in place around the pipe throughout the pipe string assembly. Descriptive material in this disclosure is oriented to throated tongs because a system that operates with a throat can do quite well without the throat and the gearing arrangement peculiar to throated tongs. Tongs, however, that were not inteded to use an open throat cannot easily be changed to add a throat.

If back-up tongs are used to hold pipe essentially non-rotational, while power tongs rotate a mating pipe section, the powered ring disclosed herein can be used and held stationary to serve the back-up function. Further, the drive ring can be effectively welded to the body. The driven end of the lines will then, consequently, be anchored to the body.

Having described the essential elements of the more complicated open throat power tongs of this invention, it is deemed unnecessary to show in detail the version without a throat. Further, having described in detail tongs with means to rotate machinery to which the driven ends of lines are attached, it is deemed unnecessary to describe in detail the structure held non-rotational to which the driven ends of the lines are attached.

Simpler versions of the tongs of this invention are anticipated by and are within the scope of the claims.

The expression "braking" is used herein with regard to the reel carrier ring. The reel carrier ring is necessarily powered and the power is, preferably, supplied by a hydraulic motor. Fluid motors are available with built-in torque limiting relief valves. Such valves are the equivalent to relief valves connecting both motor fluid ports. When common fluid motors are reversed, the function of intake and exhaust ports are reversed. A bi-directional relief valve is, therefore, required for a general purpose motor. The torque limiter valve is usually adjustable. Use of the torque limited motor serves as the preferred brake for the reel carrier ring. The torque limiting valve serves the braking purpose whether the fluid pressure source is on, off, or reversed. A bi-directional relief valve is equivalent to two relief valves, oppositely oriented, and commonly connected at the flow ends.

Motors of many types are available with friction brakes directly connected to the shafts. Some provide constant drag but most such brakes are automatically activated when power to the motor is turned off. Friction braked motors of either type are optional drives for the reel carrier ring.

Use of either the torque limited or friction braked motors is anticipated by and is within the scope of the claims.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. An open throat power tong assembly for rotating pipe to make up or break apart a threaded connection, comprising:

(a) a tong body having a generally central opening therethrough, and a pipe-receiving throat opening at one side of the body into said central opening;

(b) a partial drive ring rotatably mounted on said body and defining an opening at one side thereof adapted for alignment with said throat in one rotational position;

(c) a partial reel carrier ring rotatably mounted on said body and defining an opening at one side thereof adapted for alignment with said throat in one rotational position;

(d) a plurality of spring biased rewind reels mounted on said partial reel carrier ring distributed about the rotational axis, situated such that flexible elements stored on said reels may be pulled from said reels in the general direction of said generally central opening, when pulling force on said flexible element exceeds a preselected amount, said reels capable of recovering said flexible element when said pulling force is reduced below said preselected amount;

(e) first driving means mounted on said body and drivingly engaging said partial drive ring in rotation about said throat;

(f) second driving means mounted on said body and drivingly engaging said partial reel carrier ring for independent rotation relative to said partial reel carrier about said throat; and (g) a plurality of elongated flexible elements, each having a driven end and a tailed end, said tailed end capable of retraction into one of said reels, said driven and attached to said driven ring such that relative rotation of said two partial rings will wrap said line around the periphery of pipe situated in said opening.

2. The apparatus of claim 1 further providing level wind means operatively associated with said flexible element such that as said flexible element is pulled from said reels, the path of said flexible elements will be urged in a direction relative to the axis of rotation of said reel carrier ring, so that line will advance axially along the periphery of a pipe situated in said throat, as said flexible element is wrapped around the pipe.

3. The apparatus of claim 2 further providing that said level wind means to move said flexible element axially along the pipe periphery, as the flexible element is applied to the pipe, be responsive to rotation of said reels relative to the reel mounting structure.

4. The apparatus of claim 2 further providing that said level wind means move said flexible element axially along the pipe periphery in response to rotation of said reel carrier ring relative to said drive ring.

5. The apparatus of claim 4 further providing means to reverse said axial motion of said level wind means with respect to the relative rotational direction of said two partial rings.

6. The apparatus of claim 1 further providing structure on said reel carrier partial ring extending some distance from said reel carrier partial ring in the axial direction of a pipe to be rotated, further providing guide slots in the structure to accommodate said flexible elements and provide peripheral loads to said flexible elements when rotational effort is applied to the pipe by said flexible elements.

7. The apparatus of claim 1 further providing slots in said partial drive ring structure situated to apply peripheral forces to each flexible element as said flexible elements exert pulling loads to the pipe periphery.

8. The apparatus of claim 1 further providing that means for mounting said partial reel carrier ring on said body be accomplished indirectly by mounting said partial reel carrier ring for rotation on said partial drive ring, which, in turn, is mounted for rotation on said body.

9. The apparatus of claim 1 further providing that said second driving means drivingingly engaged with said partial reel carrier ring provided braking action to oppose tangential pull on said flexible elements to provide tailing tension to cause said flexible elements to peripherally grip pipe to be rotated when said partial drive ring is rotated to rotate pipe.

10. The apparatus of claim 1 further providing torque limiting means to adjustably limit driving torque to the partial reel carrier ring and further limit the ability of the ring to resist rotation induced by tension forces on said flexible elements.

11. The apparatus of claim 10 further providing an adjustable slip clutch between said means to drive said partial reel carrier ring and said partial reel carrier ring.

12. The apparatus of claim 1 further providing that said second driving means drivingly engaged with said partial reel carrier ring include a fluid motor with relief valves in fluid lines to said motor such that said motor, in either direction of rotation, can apply only limited torque to said partial reel carrier ring.

13. The apparatus of claim 1 further providing an adjustable brake for said reels to change the tension required to pull said flexible elements from said reels.

14. A power tong assembly for roating pipe to make up or break apart a threaded connection, quouates comprising:

(a) a body with a generally central opening to accept pipe, the body disposed about an imaginary line passing through said opening;

(b) a reel carrier ring mounted on said body for rotation about said imaginary line and having a generally central opening;

(c) a drive ring mounted on said body for rotation about said imaginary line and having a generally central opening;

(d) a plurality of reels mounted on said reel carrier ring and distributed about said opening, said reels capable of rotation to store, dispense, and rewind flexible elements;

(e) means associated with each of said reels to resist said dispensing of flexible element;

(f) means associated with each of said reels to rewind flexible elements;

(g) a plurality of elongated flexible elements, each having a driven end and a tailed end, said tailed end wound on said reels, each driven end anchored to said drive ring, said anchore distributed about said opening;

(h) a first drive means operatively associated with and to apply independent rotational effort to said reel carrier ring, mounted on said body said independent rotational effort being relative to said drive ring; and (i) a second drive means operatively associated with and to rotationally drive said drive ring, mounted on said body.

15. The apparatus of claim 14 further providing level wind means operatively associated with said flexible element such that as said flexible element is pulled from said reels, the path of said flexible elements will be urged in a direction relative to the axis of rotation of said reel carrier ring, so that line will advance axially along the periphery of a pipe situated in said opening as said flexible element is wrapped around the pipe.

16. The apparatus of claim 15 further providing that said level wind means to move said flexible element axially along the pipe periphery, as the flexible element is applied to the pipe, be responsive to rotation of said reels relative to the reel mounting structure.

17. The apparatus of claim 15 further providing that said level wind means move said flexible element axially along the pipe periphery in response to rotation of said reel carrier ring relative to said drive ring.

18. The apparatus of claim 17 further providing means to reverse said axial motion of said level wind means with respect to the relative rotational direction of said two partial rings.

19. The apparatus of claim 14 further providing structure on said reel carrier ring extending some distance from said reel carrier ring in the axial direction of a pipe to be rotated, further providing guide slots in the structure to accommodate said flexible elements and provide peripheral loads to said flexible elements when rotational effort is applied to the pipe by said flexible elements.

20. The apparatus of claim 19 further providing slots in said drive ring structure situated to apply peripheral forces to each flexible element as said flexible elements exert pulling loads to the pipe periphery.

21. The apparatus of claim 14 further providing that means for mounting said reel carrier ring on said body be accomplished indirectly by mounting, said reel carrier ring for rotation on said drive ring which, in turn, is mounted for rotation on said body.

22. The apparatus of claim 14 further providing that said driving means drivingly engaged with said reel carrier ring provide braking action to oppose tangential pull on said flexible elements to provide tailing tension to cause said flexible elements to peripherally grip pipe to be rotated when said drive ring is rotated to rotate pipe.

23. The apparatus of claim 14 further providing torque limiting means to adjustably limit driving torque to the reel carrier ring and further limit the ability of the ring to resist rotation induced by tension forces on said flexible elements.

24. The apparatus of claim 23 further providing an adjustable slip clutch between said means to drive said reel carrier ring and said reel carrier ring.

25. The apparatus of claim 14 further providing that said first driving means drivingly engaged with said reel carrier ring include a fluid motor with relief valves in fluid lines to said motor such that said motor, in either direction of rotation can apply only limited torque to said reel carrier ring.

26. The apparatus of claim 14 further providing an adjustable brake for said reels to increase the tension required to pull said flexible elements from said reels.

* * * * *